US006360774B1

(12) United States Patent
Becker et al.

(10) Patent No.: US 6,360,774 B1
(45) Date of Patent: Mar. 26, 2002

(54) SANITARY FITTING

(75) Inventors: Albert Becker, Wittlich; Josef Behr, Schalkenmehren, both of (DE)

(73) Assignee: Ideal-Standard GmbH & Co. oHG

( * ) Notice: Subject to any disclaimer, the term of this patent is extended or adjusted under 35 U.S.C. 154(b) by 0 days.

(21) Appl. No.: 09/381,280

(22) PCT Filed: Mar. 10, 1998

(86) PCT No.: PCT/EP98/01367

§ 371 Date: Sep. 20, 1999

§ 102(e) Date: Sep. 20, 1999

(87) PCT Pub. No.: WO98/41698

PCT Pub. Date: Sep. 24, 1998

(30) Foreign Application Priority Data

Mar. 18, 1997 (DE) ..... 197 11 188
Apr. 17, 1997 (DE) ..... 197 15 976

(51) Int. Cl.[7] ..... E03C 1/04
(52) U.S. Cl. ..... 137/801; 4/677; 137/359
(58) Field of Search ..... 4/677; 137/359, 137/801

(56) References Cited

U.S. PATENT DOCUMENTS 4,761,839 A * 8/1988 Ganaway ..... 239/579 X
5,090,062 A * 2/1992 Hochstrasser ..... 137/801 X
5,158,234 A * 10/1992 Magnenat et al. ..... 4/678 X

FOREIGN PATENT DOCUMENTS

| | | |
|---|---|---|
| CH | 654 610 | 2/1986 |
| DE | 28 29 081 | 1/1980 |
| DE | 42 41 886 | 6/1993 |
| DE | 93 21 076 | 1/1996 |
| DE | 295 16 157 | 4/1997 |
| DE | 296 20 660 | 4/1997 |
| EP | 0 266 296 | 5/1988 |
| EP | 0 622 497 | 11/1994 |
| GB | 2 024 377 | 1/1980 |

* cited by examiner

*Primary Examiner*—Gerald A. Michalsky
(74) *Attorney, Agent, or Firm*—Nixon Peabody LLP; David S. Safran

(57) ABSTRACT

A sanitary fitting including a fitting body with at least one supply channel and at least one discharge channel, at least one supply line which is flow-connected to the supply channel for providing flow connection to a supply network, a drain arm which is flow-connected to the discharge channel, at least one actuating element for adjusting the amount of flow and/or flow temperature, and a fastening element for fastening the fitting body to a base, the fastening element including at least one receiver for frictionally engaging the at least one supply thereby removably securing the fitting body to the base.

8 Claims, 2 Drawing Sheets

SANITARY FITTING

BACKGROUND OF THE INVENTION

1. Field of the Invention

The invention relates to a sanitary fitting with an especially cylindrical fitting body which has at least one supply channel and one discharge channel, at least one supply which is flow-connected to the supply channel and which establishes the connection to the supply network, a drain arm which is flow-connected to the discharge channel, at least one actuating element which is used to adjust the amount of flow and/or flow temperature, and a fastening element which is used for attachment to a base, the fastening element being permanently connected to the base.

2. Description of the Related Art

Sanitary fittings of this general type have long been known in the prior art. They are used when the drain arm is made as a swivel arm, such as fittings used in the kitchen which are typically single-lever, single-hole mixing faucets. Generally, the known sanitary fittings have two supply channels. One supply channel is used to supply cold water and one supply channel is used to supply hot water. In so-called low pressure fittings, the sanitary fitting has two supply channels and one drain channel, the cold water being supplied to a low pressure water heater, via the drain channel. The delivery of cold water providing for the hot water in the low pressure water heater is supplied to the sanitary fitting via the second supply channel. In the known sanitary fittings, the supplies which are flow-connected to the supply channel and which establish the connection to the supply network are made either as copper pipes or flexible hoses which are generally wire wrapped. These supplies are connected to the supply network via comer valves. The sanitary fittings known from the prior art have a fastening element which is used for attachment to a base. The base in the kitchen area consists, for example, of a working surface or a sink unit. In the known sanitary fittings, the fastening element is permanently connected both to the base and also to the fitting, body. After installing the sanitary fitting it can be detached from the base only with considerable effort and with the corresponding special knowledge.

This permanent connection of the sanitary fitting to the base leads to problems, especially when the sanitary fitting is located in an area in which the sanitary fitting is a barrier in certain activities. Thus, for example, it happens rather frequently that a sanitary fitting is located in the swivel area of an adjacent window or would be located there if the sanitary fitting were not to represent a barrier when the window is being opened.

SUMMARY OF THE INVENTION

The primary object of the present invention is to embody and improve the known, above explained sanitary fitting such that it can also be located in areas in which it represents a barrier, for example, to opening of a window.

In accordance with the one embodiment of the present invention, the above derived object is achieved in that the sanitary fitting is connected to the fastening element via connection means which is easily detachable by the user. The embodiment in accordance with the invention makes it possible for the user to detach the fitting body with the drain arm and the actuating element attached thereto, from the fastening element (for example) before opening a window, and to place it aside or in the basin so that the window can be opened without hindrance. Thus, a nonobstructing arrangement of a sanitary fitting, becomes possible in areas in which in the known sanitary fittings they would have represented an obstruction.

If the fastening element as the connection means has at least one receiver which is frictionally engaged to the supply in the connected state, the easily detachable connection in accordance with the present invention is produced with especially little effort while at the same time it is guaranteed that this easily detachable connection can also be used for known, commercially available sanitary fittings in conjunction with correspondingly configured fastening elements.

Since a receiver made radially symmetrical would also have to make available the frictional engagement counteracts which the torque which occurs when the actuating element is actuated, it is advantageous to allow the supply and the receiver to be locked together. This ensures that the frictional engagement need not capture the high torque delivered to the fitting body on the stop of the actuating element. Accordingly, the frictional engagement can be weaker so that the fitting body can be easily detached from the fastening element.

The sanitary fitting in accordance with the invention may be practiced another preferred embodiment where the fastening element has a cylindrical guide and the receiver which preferably forms the connection means, is made in a sleeve which can be pushed into the cylindrical guide and which is matched to the cylinder guide. To prevent the sleeve from being easily lifted out of the cylindrical guide when the actuation element (which is preferably made as a lever) is actuated, it is also advantageous to provide frictional engagement between the cylindrical guide and the sleeve.

The described embodiment of the present invention makes it possible to match a fastening element attached to a base by correspondingly matched push-on sleeves to the supply arrangement of different sanitary fittings by correspondingly configured receivers. In this embodiment, it is likewise conceivable for the sleeve to be permanently connected to the fitting body and thus, the cylindrical guide and the sleeve which can be pushed into this cylindrical guide form the connection means.

If the actuation element is made as the lever of a single-lever mixing faucet, a torque, as already mentioned, acts on the sanitary fitting when adjusting the temperature via the lever by swivelling sideways. To counteract this torque, in the cylindrical guide and/or on the sleeve there is a locking element. This locking element ensures that the torque acting on the sanitary fitting is routed into the fastening element and counteracted so that the sanitary fitting is not twisted.

One configuration of the locking arrangement which is especially easy to produce is by the locking element being made as a projection in the cylindrical guide, and providing a corresponding recess in the sleeve. With a locking element made in this way, it is ensured that the sleeve inserted into the cylindrical guide can no longer be twisted relative to the cylindrical guide. This type of locking can of course, be reversed with respect to the arrangement of the recess and projection.

Alternative to the arrangement of a separate locking element, the sanitary fitting in accordance with the present invention is also embodied by the cylindrical guide having a cross section which is variable in radius, especially elliptical, and the sleeve having a correspondingly matched cross section for locking purposes. Since twisting between the sleeve and the cylindrical guide is only possible when the cylindrical guide and the sleeve are made circularly cylindrical, the described embodiment easily ensures locking. Of course, not only ellipses are conceivable as cross sections. It is also conceivable by way of example that the cylindrical guide and the sleeve have an octagonal cross section.

A reliable seating of the sleeve in the cylindrical guide and protection against overly easy lifting of the sleeve out of the cylindrical guide are ensured by the insertion length of the sleeve corresponding to roughly twice the diameter of the cylindrical guide.

Alternatively or cumulatively to the above explained embodiment, there is an axially working catch element between the cylindrical guide and the sleeve for protection against overly easy lifting. Preferably, when the sleeve is inserted into the cylindrical guide this catch element provides for surface pressure between the top end of the sleeve or the bottom end of the fitting body and the top end of the fastening element so that a sealing action, for example, against splashing water, is ensured.

Alternatively to the embodiments of the sanitary fitting as described above, the connection means may also be made as a quarter turn fastener. One such quarter turn fastener does not allow unintentional removal of the sanitary fitting from the fastening element, but is somewhat more complex to produce than the alternative explained above.

In the execution of the supply, there are two possible embodiments.

According to the first alternative, the supply is permanently connected to the fitting body and is made as a flexible hose. This embodiment is especially simple since the fitting body need not be adapted relative to the known fitting body. In this embodiment, the fitting body with the supplies which are made hose-shaped and which are connected thereto is detached from the fastening element and is put aside or placed in the basin at a distance limited by the hose length.

According to a second embodiment, the sanitary fitting is embodied in that the supply is permanently connected to the fastening element. In this embodiment it is possible to form both the supply as a flexible hose or also as a copper tube since the supply is not affected by detaching the fitting body from the fastening element. This embodiment, makes it possible to completely remove the sanitary fitting from the vicinity of the fastening element. In this embodiment, however, it is not possible for there to be a receiver frictionally engaged to the supply in the connected state as the connection means, since the supplies are likewise detached from the fitting body when the fitting body is detached from the fastening element.

In the above described second alternative, it is problematic that the connection between the supply and the supply network must always be separated, for example, via corner valves, without other measures before detaching the fitting body from the fastening element. This problem can be circumvented by providing return valves on the fastening element which close the supply when the fitting body is detached.

In particular, there are various possibilities for embodying and developing the sanitary fitting in accordance with the present invention.

DETAILED DESCRIPTION OF THE INVENTION

Figure 1:
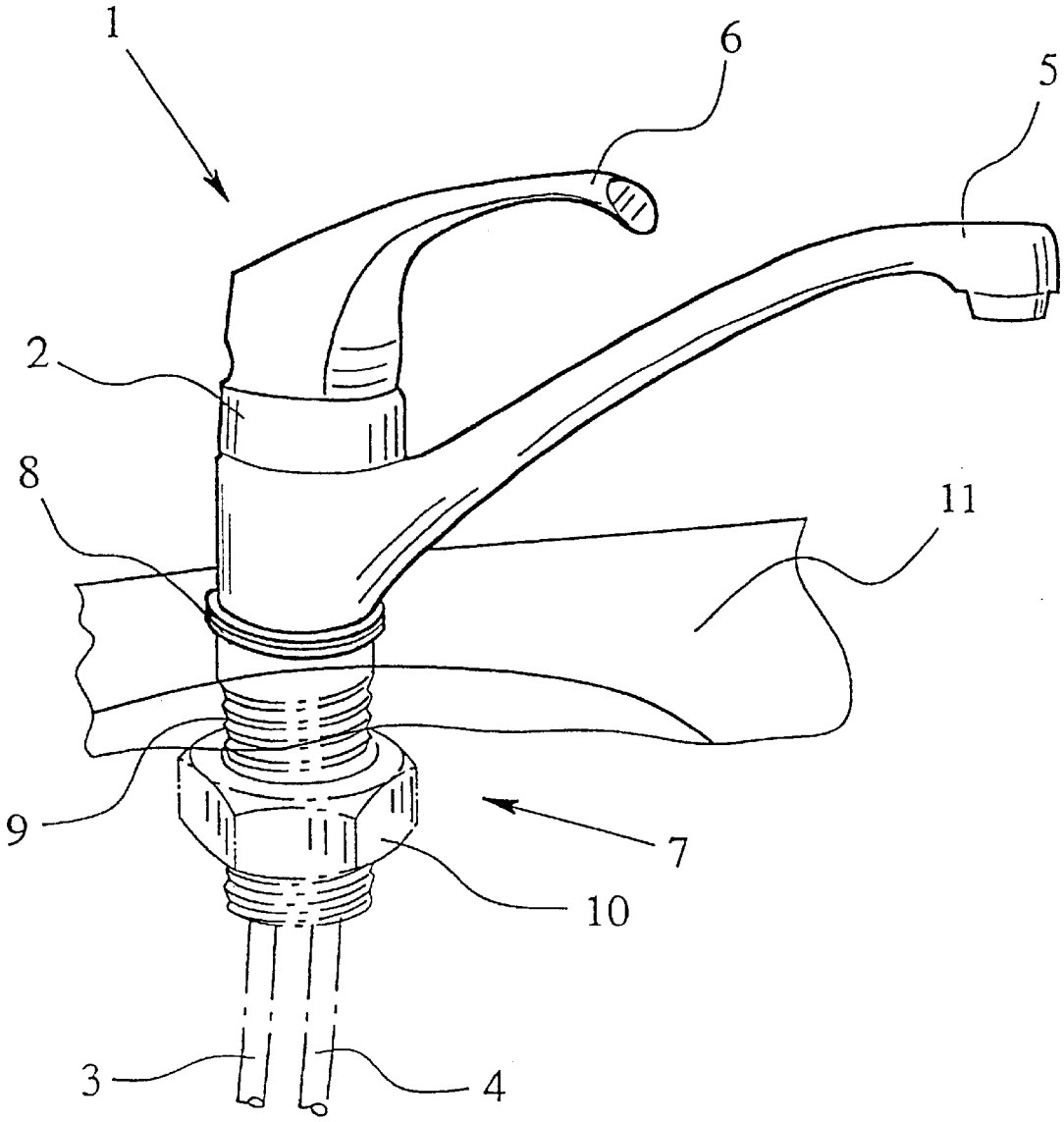
FIG. 1 shows one embodiment of a sanitary fitting in accordance with one embodiment of the present invention in the state connected to the fastening element and FIG. 2 shows an enlarged view, partially cutaway, of the fastening element and of the connection element of the sanitary fitting made in accordance with the present invention.

FIG. 1 shows one embodiment of the sanitary fitting 1 in accordance with one embodiment of the present invention. The sanitary fitting 1 has a cylindrical fitting body 2 which has two supply channels which are not shown and one discharge channel which is not shown. The connection to the supply network is established in the embodiment shown in FIG. 1, by two supplies 3, 4 which are flow-connected to the supply channels which are not shown. Furthermore, a drain arm 5 which can be swivelled in this illustrated embodiment is flow-connected to the discharge channel which is not shown. The embodiment of a sanitary fitting 1 shown in FIG. 1 is a single-lever, single-hole mixing faucet. Accordingly, the actuating element 6 which is used to adjust the amount of flow and/or flow temperature is made as a lever which can be turned in the conventional manner around the axis of the fitting body 2 and can be swivelled up and down around one axis perpendicular to the axis of the cylindrical fitting body 2.

FIG. 1 furthermore clearly shows the fastening element 7 which is used for attachment to the base. The fastening element 7 in the illustrated embodiment of a sanitary fitting 1 is made circularly cylindrical, has a flange 8 on its top end, and is provided on the outside with a thread 9. Finally, a nut 10 is screwed onto the thread 9 so that the interaction of the flange 8 and nut 10 permanently joins the fastening element 7 to the base made here as a working surface 11.

Figure 2:
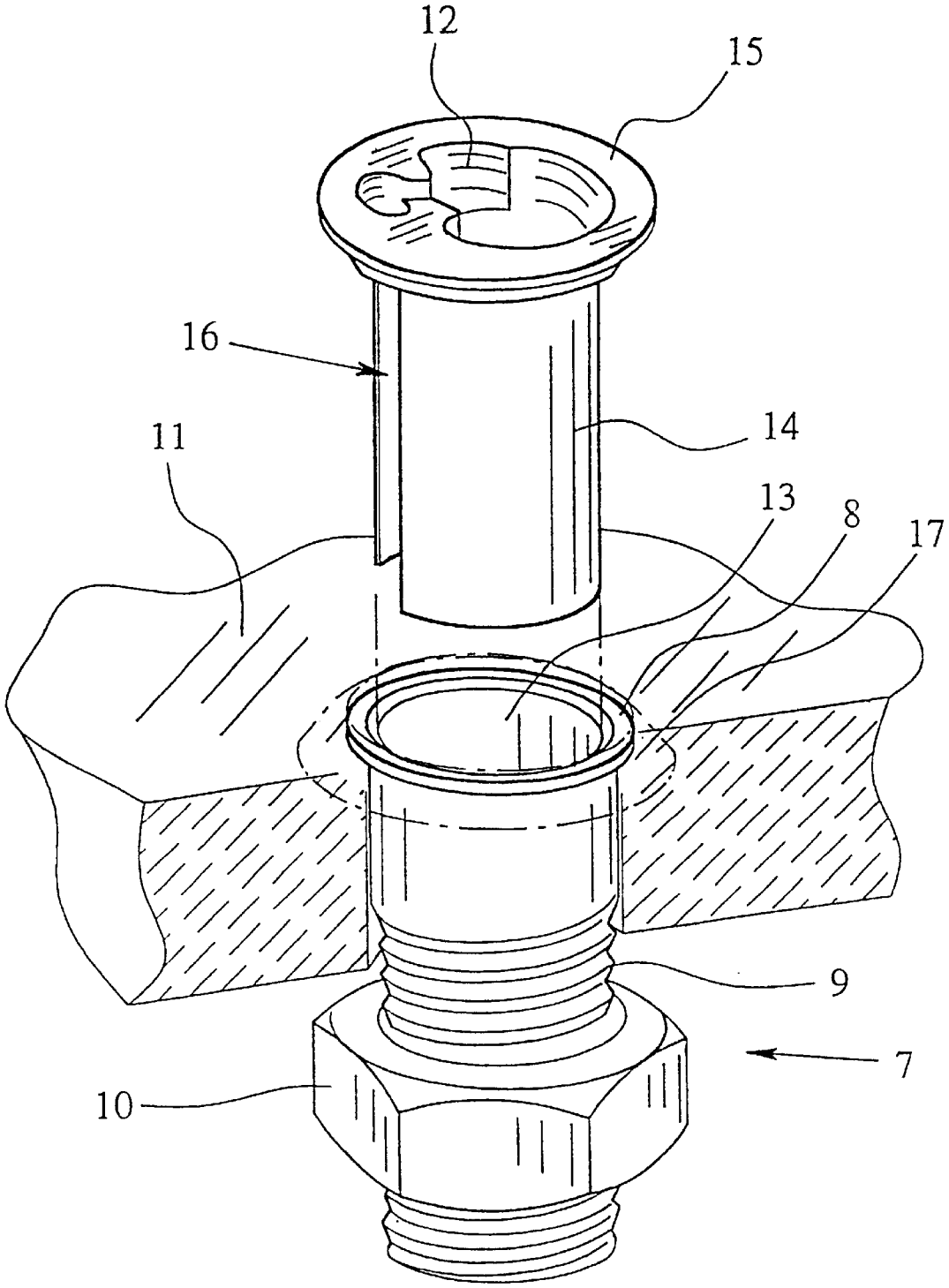

The sanitary fitting in accordance with the present invention follows especially clearly from FIG. 2. FIG. 2 shows in turn the fastening element 7 with the flange 8, the thread 9, and the nut 10, located in a hole of a working surface 11. In the embodiment of the fastening element 7 shown, there is a receiver 12 on an attachment flange 15 at the top end of the sleeve 14 for frictionally engaging to the supplies 3, 4 in the connected state. The sleeve 14 is adapted to be pushed into a circularly cylindrical guide 13. The circularly cylindrical guide 13 is thus matched to the sleeve 14 such that the frictional engagement between the circularly cylindrical guide 13 and the sleeve 14 is greater than the frictional engagement between the receiver 12 of the attachment flange 15 and the supplies 3, 4. In the embodiment of a sanitary fitting shown in FIG. 2, the attachment flange 15 is made such that the supplies 3, 4 from the prior art of known sanitary fittings can be inserted and be frictionally engaged to the receiver 12. This yields the possibility of developing in accordance with the present invention, the fitting bodies from the prior art of known sanitary fittings simply by replacing the fastening element 7 so that these sanitary fittings can be lifted out of the fastening element 7 and put aside and thus, they no longer represent a barrier, for example, in the swivel area of a window.

If on the other hand, the fitting body 2 is permanently connected via the attachment flange 15 to the sleeve 14, the connection means is formed by the cylindrical guide 13 and the sleeve 14 which can be pushed into the cylindrical guide 13, and are connected by frictional engagement to one another in the inserted state.

Furthermore, it can be recognized in FIG. 2 that the sleeve 14 has one recess 16 on one side. This recess 16 is preferably also provided on the opposite side of the sleeve 14. The recess 16 acts together with projections (not shown here) in the guide 13 as a locking element.

In the embodiment of a sanitary fitting in accordance with the present invention shown in FIG. 2, the insertion length of the sleeve 14 is roughly twice as large as the diameter of the cylindrical guide 13. By this measure, in combination with existing frictional engagement between the guide 13 and the sleeve 14 high reliability is ensured against unintentional lifting of the sleeve 14, out of the guide 13.

The supplies 3, 4 are permanently connected to the fitting body 2 and are made as flexible hoses in the embodiment of a sanitary fitting 1 shown in the drawings. Accordingly, the supplies 3, 4 must have an excess length and enable the sanitary fitting 1 to be lifted out and put aside. Since the flexible hoses which form the supplies 3, 4 are generally jacketed with wire mesh, they are well protected against external damage in spite of their flexibility.

Finally, it remains to be mentioned that the flange 8 of the fastening element 7 and the attachment flange 15 of the sleeve 14 are partially bevelled corresponding to one another in order to ensure as good a seal as possible against water splashing between the fastening element 7 and the attachment flange 15. In addition, a rosette 17 in the shape of a truncated cone which is shown in FIG. 2 by the dashed lanes may be provided for improving the seal and appearance by covering the flange ends which project out of the working surface 11. The rosette 17, in the shape of a truncated cone, can project over the attachment flange 15 and with its top end, directly adjoin the fitting body 2 of the sanitary fitting 1. This embodiment of the rosette 17 in the shape of a truncated cone can further increase the strength of the frictional engagement between the fastening element 7 and the fitting body 2. Between the nut 10 and the working plate 11, there may also be provided a washer or rosette (not shown) for protection of the working surface 11.

What is claimed is:

1. Sanitary fitting comprising:

a fitting body including at least one supply channel and at least one discharge channel;

at least one supply line which is flow-connected to said at least one supply channel for providing a flow connection to a fluid flow supply network;

a drain arm which is flow-connected to said at least one discharge channel;

at least one actuating element for adjusting at least one of a flow amount and a flow temperature; and a fastening element for permanent attachment to a base, said fastening element including a cylindrical guide;

a sleeve containing at least one receiver which is sized and configured relative to said at least one supply line in a manner removably securing said fitting body to said sleeve by a direct friction-fit connection between the at least one receiver and the at least one supply line;

wherein said sleeve is detachably connected to said fastening element by a direct friction-fit connection between the said sleeve and said cylindrical guide by the relative dimensions thereof when said sleeve is fully inserted into said cylindrical guide and said at least one supply line is secured in said at least one receiver.

2. Sanitary fitting of claim 1, wherein said at least one supply line and said at least one receiver are lockable together.

3. Sanitary fitting of claim 1, wherein said sleeve being shaped to be received within said cylindrical guide and said receiver being provided in said sleeve.

4. Sanitary fitting of claim 3, wherein at least one of said cylindrical guide and said sleeve includes a locking element.

5. Sanitary fitting of claim 4, wherein an insertion length of said sleeve is substantially twice a diameter of said cylindrical guide.

6. Sanitary fitting of claim 3, wherein said cylindrical guide has a cross section with a varying radius and said sleeve has a correspondingly matched cross section.

7. Sanitary fitting of claim 3, wherein said sleeve is integrally connected to said fitting body.

8. Sanitary body according to claim 1, wherein the frictional engagement between the cylindrical guide and the sleeve is greater than the frictional engagement between the receiver and the supply line.

* * * * *